US005692847A

United States Patent [19]

Zane et al.

[11] Patent Number: 5,692,847

[45] Date of Patent: Dec. 2, 1997

[54] LOOSE LEAF BINDER ASSEMBLY AND SPINE THEREFOR

[76] Inventors: Barry Zane, 2572 Piccadilly Cir., Thousand Oaks, Calif. 91362; Claus Hofmann, 3835 N. Lost Springs Dr., Calabasas, Calif. 91301

[21] Appl. No.: 620,724

[22] Filed: Mar. 19, 1996

[51] Int. Cl.[6] ..... B42F 3/04

[52] U.S. Cl. ..... 402/38; 402/31; 402/26; 402/36

[58] Field of Search ..... 402/26, 36, 38, 402/31, 37, 42

[56] References Cited

U.S. PATENT DOCUMENTS

| | | | |
|---|---|---|---|
| 880,053 | 2/1908 | Troussell . | |
| 1,129,891 | 3/1915 | Morden . | |
| 1,163,766 | 12/1915 | Morden . | |
| 2,013,552 | 9/1935 | Dawson | 402/38 |
| 3,135,266 | 6/1964 | Bouhier | 402/38 |
| 3,255,759 | 6/1966 | Dennis | 402/30 |
| 3,791,059 | 2/1974 | Shneider . | |
| 4,607,970 | 8/1986 | Heusinkveld . | |
| 5,393,156 | 2/1995 | Mullin et al. | 402/38 X |

*Primary Examiner*—Willmon Fridie, Jr.

*Attorney, Agent, or Firm*—John J. Posta, Jr.

[57] ABSTRACT

The improved loose leaf ring binder assembly includes a binder having a central vertical back portion connected to laterally extending wings or side portions which form the front and back covers of the binder. The assembly also includes a vertically extending spine connected to the front surface of the back portion. The spine is in the form of a hollow tube having closed upper and lower ends and containing a spaced pair of vertical rods. The inner ends of half rings are connected to the rods at spaced intervals along the length thereof. The half rings extend laterally outwardly from the rods through openings on opposite sides of the tube. The free ends of the half rings on one side of the tube are adapted to mate with half rings from the opposite side of the tube to form complete rings to releasably hold loose perforated sheets in place in the binder. The rod secured to the half rings on one side of the spine is vertically biased by a spring in the tube to facilitate fitting the free ends of the half rings together to form complete rings. In one embodiment, the half rings on one side of the spine are locked against rotation, as by fixedly connecting in the tube the rod to which they are connected. In another embodiment, a sleeve which can be screwed into and out of contact with the spring biased rod end can releasably lock the rings shut or open. The pair of rod and half rings can be identical, in some embodiments.

20 Claims, 1 Drawing Sheet

LOOSE LEAF BINDER ASSEMBLY AND SPINE THEREFOR

BACKGROUND OF THE INVENTION

1. Field of the Invention

The present invention generally relates to paper holding means and more particularly to an improved type of loose leaf paper binder and the novel spine utilized in the binder, 2. Prior Art A wide variety of binders have been used to releasably bind together a plurality of hole-punched loose leaf sheets of paper and the like. Most binders are characterized by an outer enclosure which opens like a book and comprises front and rear covers joined together by a central backing strip or the like.

Certain of such binders employ spaced openable rings or clips which are connected directly to the backing strip and which project forwardly therefrom between the covers. In certain others of such binders the rings or clips are connected to a spine which is in turn connected to the backing strip. Difficulties are encountered in easily opening and in securely closing the rings or clips so that the perforated sheets of paper fed unto the rings or clips are held in place easily and can be readily flipped over for use of both sides of such sheets.

One form of binder spine employs strong springs which cause the rings to snap apart and then allows them to be snapped closed, all in a horizontal plane. Considerable force is needed to open and close the rings. Since the mating ends of the rings usually contain sharp prongs, there is a danger of accidentally piercing a finger when closing the rings. The springs are relied upon to hold the rings closed, but such springs tend to weaken during use, so that the rings may eventually remain partially open, permitting paper sheets held on the rings to become easily dislodged therefrom.

Accordingly, there is a need for a new, safe, durable and efficient type of loose leaf binder assembly which overcomes the foregoing difficulties. Such assembly should include rings which are easy to open and close but are safe and which can be locked in a closed position. The assembly should also provide means such that one half of the split rings can be held in a fixed position while the other half of the split rings can be opened and closed for more convenient insertion of paper thereon and removal therefrom. The assembly should be simple, inexpensive and capable of being made in a variety of sizes.

SUMMARY OF THE INVENTION

The improved loose leaf binder assembly of the present invention and the spine utilized in the assembly satisfy all the foregoing needs. The assembly is durable, efficient, easy and safe to use and employs split rings which can be locked positively closed. Moreover, one half of each split ring can be made to hold a fixed position which the other half of each ring can easily be urged into the open or closed position.

The improved assembly and spine of the present invention are substantially as set forth in the ABSTRACT OF THE DISCLOSURE. Thus, the assembly comprises a binder which opens like a book and includes front and back covers joined by a backing or end portion which may be integral with the covers.

The assembly also includes a new and advantageous type of spine connected to the front surface of the backing portion. The spine is an elongated hollow, preferably vertical tube which contains two spaced elongated rods, one of which rods is connected to a spring which biases that rod into a down position in the tube. Split rings are connected to the rods and extend horizontally laterally and forwardly through side openings in both sides of the tube at spaced intervals along the length of the tube. One half of each split ring is connected to one rod and the other half of the split ring is connected to the other rod.

At least one of the rods can be rotated around its longitudinal axis to open and close the split rings. During such opening or closing the spring biased rod can be urged manually upwardly, as by pushing up on one of the half rings to which it is connected so that the rings can be moved easily into the open and closed position, with mating detents on the free ends of the split rings either engaging or disengaging, with no danger of snap pinching of the fingers as with conventional spring biased rings.

Moreover, the spine can be provided with a threaded sleeve or the like which can be manually positioned to prevent upward movement of the spring biased rod and thus prevent opening of the rings when closed. The sleeve can extend out of the top of the tube and be turned by a handle connected thereto.

If desired, one of the rods can be secured against rotation in the tube, thus preventing the half rings connected thereto from moving. Alternatively, those half rings can include a detent which locks them to a fixed position against rotation.

Also, the pair of rods and rings can be exactly the same, but one turned upside down to make each operable set.

The binder and spine can be of metal, plastic or the like suitable, durable, inexpensive materials. Various features of the improved assembly and spine are as set forth in the following detailed description and accompanying drawings.

DRAWINGS

Figure 6:
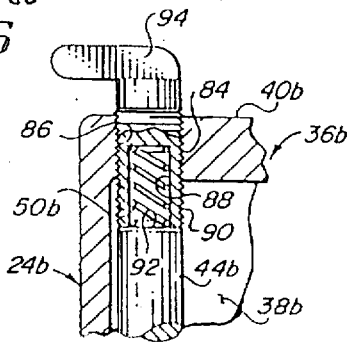
Figure 7:
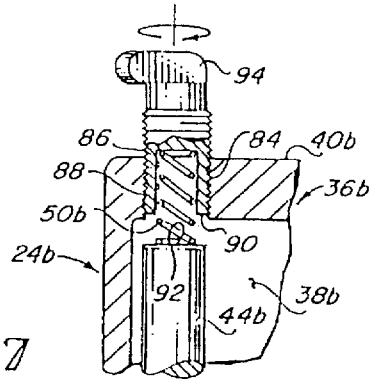

FIG. 6 is a further enlarged fragmentary schematic view, partly broken away and partly in section, showing details of the engagement of a threaded sleeve with the spring and upper end of a rod in the spine tube, the sleeve being in an "up" position which permits vertical movement of the rod for opening and closing the rings associated therewith; and, FIG. 7 is a view comparable to that of FIG. 9 but showing the sleeve screwed into a "down" position which locks the rings associated with the rod in a fixed position.

Figure 8:
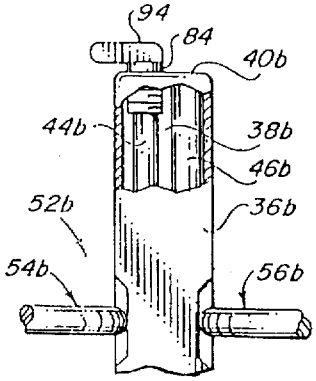

FIG. 8 is an enlarged fragmentary schematic front elevation, partly broken away, of a third preferred embodiment of the spine of the present invention;

DETAILED DESCRIPTION

FIGS. 1–5

A first preferred embodiment of the improved loose leaf ring binder assembly of the present invention and a spine utilized therein is schematically depicted in FIGS. 1–5. Thus, assembly 20 is shown which comprises a binder 22 and a spine 24 preferably releasably connected thereto, as by screws 26.

Binder 22 is generally shaped like a book and includes a vertical central back portion 28 preferably integrally connected to wings or side portions 30 and 32 which serve, respectively, as front and back covers for binder 22. Spine 24 is connected to the front surface 34 of back portion 28 and extends vertically therewith.

Spine 24 comprises a hollow tube 36 having a central space 38 and closed upper and lower ends 40 and 42. Two long rods 44 and 46 are spaced parallel each other in space 38, extend substantially the length of space 38, which runs the length of tube 36, and are secured for rotation about their longitudinal axes in tube 36. However, rod 44 is shortened at its upper end to provide a space 48 within which spring 50 is seated. Spring 50 biases rod 44 in the "down" position in tube 36.

Split rings 52 are spaced along the length of tube 36, each ring 52 comprising a half ring 54 and a mating half ring 56. Half rings 54 have end 58 thereof fixedly connected to rod 44 and the opposite free end 60 thereof defining a squared notch 62 and detent 63. The main portion of half ring 54 projects outwardly laterally and forwardly from a slot 64 in side 66 of tube 36. Half rings 56 have end 68 fixed to rod 46 and free end 70 defining a squared notch 72 and detent 73. Detent 73 mates with notch 62 and detent 63 mates with notch 72 (FIG. 3). The main portion of half ring 56 projects outwardly laterally and forwardly from a slot 74 in opposite side 76 of tube 36. Half rings 54 rotate horizontally as a unit, as do half rings 56, into the open and closed positions of, respectively, FIGS. 1–2 and FIG. 3

Figure 1:
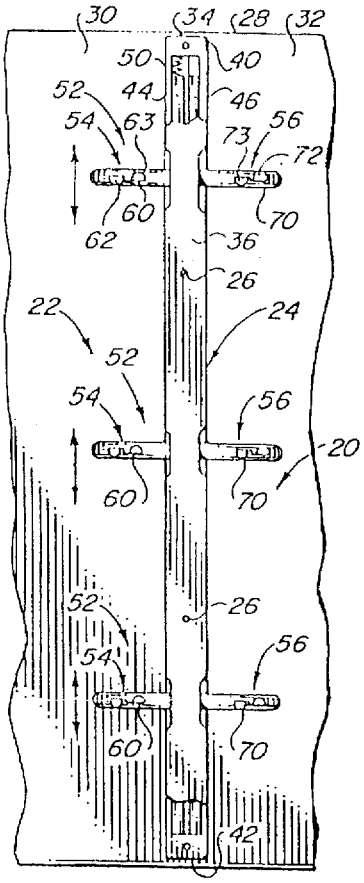
FIG. 1 is a schematic front elevation, partly broken away, of a first preferred embodiment of the improved loose leaf binder assembly of the present invention, including the spine thereof.
Figure 2:
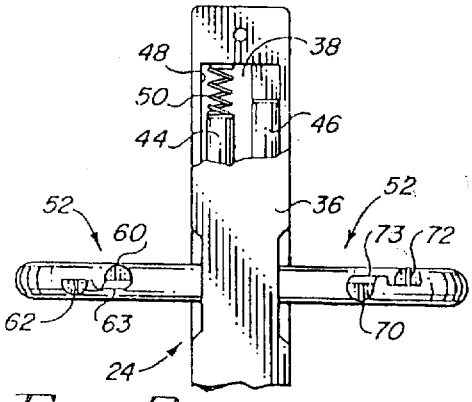
FIG. 2 is an enlarged fragmentary schematic front elevation, partly broken away, of the upper end of the spine of FIG. 1, showing half rings in the open position.
Figure 3:
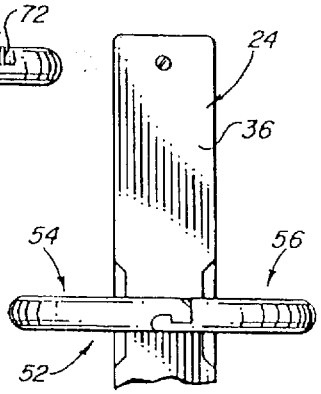
FIG. 3 is an enlarged fragmentary schematic front elevation of the upper end of the spine of FIG. 1, showing half rings in the closed position.
Figure 4:
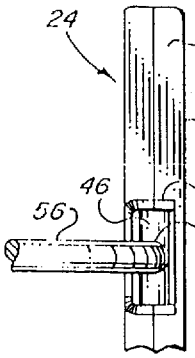
FIGS. 4 and 5 are enlarged fragmentary schematic elevations of opposite sides of the upper end of the spine of FIG. 1, showing half rings extending from rods in the spine out through side openings in the spine.
Figure 5:
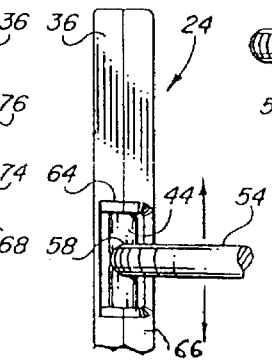

Thus, when it is desired to close rings 52, half rings 54 and 56 are manually rotated from the open position of FIGS. 1 and 2 to the closed position of FIG. 3, while pressing up on one or more half rings 54 against the bias of spring 50 so that free ends 60 pass over free ends 70 and can be aligned therewith, (relative to notches and detents) after which the upward pressing is terminated and ends 60 engage ends 70 as shown in FIG. 3 to safely lock them together. Similarly, when it is desired to unlock rings 52, one or more half rings 54 are pressed up to disengage ends 60 and 70, after which half rings 54 and 56 are rotated away from each other and the upward pressing is then terminated. With this arrangement, loose leaf sheets can be easily and safely connected to and removed from rings 52.

If desired, rod 46 and rings 56 can be rigidly secured to spine 24 by welding, set screws, etc., to prevent rotation therebetween. In this case, only half rings 54 rotate (with rod 44) into and out of a closed locked position. Half rings 56 remain in a fixed position comparable to the closed position of half rings 51. This simplifies the opening and closing of split rings 52.

FIGS. 6–8

A second preferred embodiment of the improved spine of the present invention is schematically set forth in FIGS. 6–8. Thus, spine **24*b* is shown. Components thereof similar to those of spine 24** bear the same numerals but are succeeded by the letter "b".

Spine **24*b* is substantially identical to spine 24 except that spine 24*b* contains means for positively locking rings 52 closed. Thus, spine 24*b* includes a threaded sleeve 84 which is threaded down through a threaded opening 86 in the upper end 40*b* of tube 36*b*. Sleeve 84 has an internal cavity 88 which receives spring 50*b* and a lower end 90 which engages the upper end 92 of rod 44*b*. Sleeve 84 is connected to a turn handle 94 above tube 36*b* so that sleeve 84 can be moved between the "up" position of FIG. 6 wherein it does not interfere with the vertical lifting of rod 44*b* and half rings 56*b* for engagement and disengagement of half rings 54*b* and 56*b*, and the "down" position of FIG. 7 wherein it prevents upward movement of rod 44*b* and half rings 54*b* and thus their disengagement from half rings 56*b*. This has the effect of positively locking rings 52*b* when in the closed position. Spine 24*b* has the other advantages of spine 24**.

Various other modifications, changes, alterations and additions can be made in the improved loose leaf ring binder assembly of the present invention and in the spine utilizable therein. All such modifications, changes, alterations and additions as are within the scope of the appended claims are part of the present invention.

What is claimed is:

1. An improved loose leaf ring binder assembly, said assembly comprising, in combination:

a) a loose leaf binder comprising a sheet of extended surface area having oppositely extending side portions and a generally central vertically extending back portion connected to the inner margins of said side portions and having a front surface and an opposite rear surface, said side portions being adapted to fold around said back portion to provide said binder with front and rear covers; and, b) a vertical spine secured to the front surface of said binder back and bearing a vertically spaced set of rings extending horizontally outwardly from opposite sides of said spine and spaced along the length thereof, each said ring comprising a mating pair of half rings, at least one of said half rings of each said pair being rotatable to open and close said ring in order to releasably hold leaf binder sheets in said binder assembly, one of said half rings of each ring extending outwardly from one side of said spine and the other half ring of each ring extending outwardly from the opposite side of said spine, the half rings on one side of said spine being secured to a first vertical rod disposed in said spine and the other half rings on the opposite side of said spine being secured to a second vertical rod disposed in said spine, one of said rods being spring biased for vertical movement of its connected half rings with respect to their respective mating rings to disengage said mating rings.

2. The improved assembly of claim 1 wherein each of said half rings has an inner end fixedly connected to one of said two rods and has an outer end projecting out through an opening in the side of said spine, at least one of said rods being rotatable in said spine.

3. An improved loose leaf ring binder assembly, said assembly comprising, in combination:

a) a loose leaf binder comprising a sheet of extended surface area having oppositely extending side portions and a generally central vertically extending back portion connected to the inner margins of said side portions and having a front surface and an opposite rear surface, said side portions being adapted to fold around said back portion to provide said binder with front and rear covers; and, b) a vertical spine secured to the front surface of said binder back and bearing a vertically spaced set of rings extending horizontally outwardly from opposite sides of said spine and spaced along the length thereof, each said ring comprising a mating pair of half rings, at least one of said half rings of each said pair being rotatable to open and close said ring in order to releasably hold leaf binder sheets in said binder assembly, one of said half rings of each ring extending outwardly from one side of said spine and the other half ring of each ling extending outwardly from the opposite side of said spine, the half rings on one side of said spine being secured to a first vertical rod disposed in said spine and the other half rings on the opposite side of said spine being secured to a second vertical rod disposed in said spine, one of said rods being spring biased for vertical movement of its connected half rings to facilitate opening and closing of said rings, c) wherein each of said half rings has an inner end fixedly connected to one of said two rods and has an outer end projecting out through an opening in the side of said spine, at least one of said rods being rotatable in said spine; and d) wherein one of said rods is fixedly secured in said spine to prevent rotation of the half rings connected to that rod.

4. An improved loose leaf ring binder assembly, said assembly comprising, in combination:

a) a loose leaf binder comprising a sheet of extended surface area having oppositely extending side portions and a generally central vertically extending back portion connected to the inner margins of said side portions and having a front surface and an opposite rear surface, said side portions being adapted to fold around said back portion to provide said binder with front and rear covers; and, b) a vertical spine secured to the front surface of said binder back and bearing a vertically spaced set of rings extending horizontally outwardly from opposite sides of said spine and spaced along the length thereof, each said ring comprising a mating pair of half rings, at least one of said half rings of each said pair being rotatable to open and close said ring in order to releasably hold leaf binder sheets in said binder assembly, one of said half rings of each ring extending outwardly from one side of said spine and the other half ring of each ring extending outwardly from the opposite side of said spine, the half rings on one side of said spine being secured to a first vertical rod disposed in said spine and the other half rings on the opposite side of said spine being secured to a second vertical rod disposed in said spine, one of said rods being spring biased for vertical movement of its connected half rings to facilitate opening and closing of said rings, c) wherein each of said half rings has an inner end fixedly connected to one of said two rods and has an outer end projecting out through an opening in the side of said spine, at least one of said rods being rotatable in said spine; and d) wherein the half rings on one side of said spine bear detents which prevent rotation of those half rings in said openings.

5. The improved assembly of claim 2 wherein said assembly includes means for releasably locking said spring biased rod against vertical movement, thereby releasably locking said rings.

6. The improved assembly of claim 5 wherein said locking means comprises a detent movable towards and away from said spring biased rod.

7. An improved loose leaf ring binder assembly, said assembly comprising, in combination:

a) a loose leaf binder comprising a sheet of extended surface area having oppositely extending side portions and a generally central vertically extending back portion connected to the inner margins of said side portions and having a front surface and an opposite rear surface, said side portions being adapted to fold around said back portion to provide said binder with front and rear covers; and, b) a vertical spine secured to the front surface of said binder back and bearing a vertically spaced set of rings extending horizontally outwardly from opposite sides of said spine and spaced along the length thereof, each said ring comprising a mating pair of half rings, at least one of said half rings of each said pair being rotatable to open and close said ring in order to releasably hold leaf binder sheets in said binder assembly, one of said half rings of each ring extending outwardly from one side of said spine and the other half ring of each ring extending outwardly from the opposite side of said spine, the half rings on one side of said spine being secured to a first vertical rod disposed in said spine and the other half rings on the opposite side of said spine being secured to a second vertical rod disposed in said spine, one of said rods being spring biased for vertical movement of its connected half rings to facilitate opening and closing of said rings, c) wherein each of said half rings has an inner end fixedly connected to one of said two rods and has an outer end projecting out through an opening in the side of said spine, at least one of said rods being rotatable in said spine;

d) wherein said assembly includes means for releasably locking said spirng biased rod against vertical movement, thereby releasably locking said rings;

e) wherein said locking means comprises a detent movable towards and away from said spring biased rod; and f) wherein said locking detent comprises a vertically disposed tubular sleeve which fits over the spring biasing said rod and engages the adjacent end of said rod to control the vertical movement of said rod.

8. The improved assembly of claim 7 wherein said spring is disposed at the upper end of said spine and wherein said sleeve is threaded up through said upper end of said spine and has a turn handle connected thereto.

9. A ring binder spine assembly capable of releasably securing sheets of paper, said spine assembly comprising an elongated hollow vertical tube bearing a vertically spaced set of rings extending horizontally outwardly from opposite sides of said tube and spaced along the length thereof, each said ring comprising a mating pair of half rings, at least one of said half rings of each said pair being rotatable to open and close said ring in order to releasably hold leaf binder sheets in said binder, one of said half rings of each ring extending outwardly from one side of said tube and the other half ring of each ring extending outwardly from the opposite side of said tube, the half rings on one side of said tube being secured to a first vertical rod disposed in said tube and the other half rings on the opposite side of said tube being secured to a second vertical rod disposed in said tube, one of said rods being spring biased for vertical movement of its connected half rings with respect to their respective mating rings to disengage said mating rigns.

10. The improved spine of claim 9 wherein each of said half rings has an inner end fixedly connected to one of said two rods and has an outer end projecting out through an opening in the side of said tube, at least one of said rods being rotatable in said tube.

11. A ring binder spine capable of releasably securing sheets of paper, said spine comprising an elongated hollow vertical tube bearing a vertically spaced set of rings extending horizontally outwardly from opposite sides of said tube and spaced along the length thereof, each said ring comprising a mating pair of half rings, at least one of said half rings of each said pair being rotatable to open and close said ring in order to releasably hold leaf binder sheets in said binder, one of said half rings of earth ring extending outwardly from one side of said tube and the other half ring of each ring extending outwardly from the opposite side of said tube, the half rings on one side of said tube being secured to a first vertical rod disposed in said tube and the other half rings on the opposite side of said tube being secured to a second vertical rod disposed in said tube, one of said rods being spring biased for vertical movement of its connected half rings to facilitate opening and closing of said rings;

a) wherein each of said half rings has an inner end fixedly connected to one of said two rods and has an outer end projecting out through an opening in the side of said tube, at least one of said rods being rotatable in said tube; and b) wherein one of said rods is fixedly secured in said tube to prevent rotation of the half rings connected to that rod.

12. A ring binder spine capable of releasably securing sheets of paper, said spine comprising an elongated hollow vertical tube beraing a vertically spaced set of rings extending horizontally outwardly from opposite sides of said tube and spaced along the length thereof, each said ring comprising a mating pair of half rings, at least one of said half rings of each said pair being rotatable to open and close said ring in order to releasably hold leaf binder sheets in said binder, one of said half rings of each ring extending outwardly from one side of said tube and the other half ring of each ring extending outwardly the opposite side of said tube, the half rings on one side of said tube being secured to a first vertical rod disposed in said tube and the other half rings on the opposite side of said tube being secured to a second vertical rod disposed in said tube, one of said rods being spring biased for vertical movement of its connected half rings to facilitate opening and closing of said rings;

a) wherein one of said rods is fixedly secured in said tube to prevent rotation of the half rings connected to that rod;

b) wherein the half rings on one side of said tube bear detents which prevent rotation of those half rings in said openings.

13. The improved spine of claim 10 wherein said tube includes means for releasably locking said spring biased rod against vertical movement, thereby releasably locking said rings.

14. The improved spine of claim 5 wherein said locking means comprises a detent movable towards and away from said spring biased rod.

15. The improved spine of claim 14 wherein said locking detent comprises a vertically disposed tubular sleeve which fits over the spring biasing said rod and engages the adjacent end of said rod to control the vertical movement of said rod.

16. The improved spine of claim 15 wherein said spring is disposed at the upper end of said tube and wherein said sleeve is threaded up through said upper end of said tube and has a turn handle connected thereto.

17. A ring binder adapted to releasably retain sheets, comprising:

a) a vertically extending spine;

b) a first set of ring members supported by a first base member which is retained within said spine, c) a second set of ring members supported by a second base member which is retained within said spine, d) said first and second set of ring members having respective mating interlocking members at the far ends thereof, e) wherein said first base member includes first locking means to prevent rotation thereof with respect to said spine, f) wherein said second base member is rotatable with respect to said spine, g) wherein said base member is vertically movable with respect to said spine so as to enable locking and unlocking of said mating members; and h) wherein second locking means are provided to prevent vertical movement of said second base member with respect to said spine.

18. The ring binder of claim 17 wherein said first and second set of ring members are substantially identical.

19. The ring binder of claim 1 wherein said first rod and associated half rings are substantially identical to said second and associated half rings.

20. The ring binder spine assembly of claim 9 wherein said first rod and associated half rings are substantially identical to said second and associated half rings.

* * * * *